United States Patent [19]

Klygis

[11] 4,018,331

[45] Apr. 19, 1977

[54] MULTIPACKAGING DEVICES

[75] Inventor: Mindaugas Julius Klygis, Evergreen Park, Ill.

[73] Assignee: Illinois Tool Works Inc., Chicago, Ill.

[22] Filed: May 29, 1975

[21] Appl. No.: 581,591

[52] U.S. Cl. ..... 206/199; 206/427

[51] Int. Cl.[2] ..... B65D 85/20

[58] Field of Search ..... 206/145, 150, 161, 199, 206/427–428, 493, 526; 229/28 R; 294/87.2

[56] References Cited

UNITED STATES PATENTS

| | | | |
|---|---|---|---|
| 3,374,028 | 3/1968 | Wanderer | 294/87.2 |
| 3,621,628 | 11/1971 | Chidsey, Jr. | 206/150 X |
| 3,733,100 | 5/1973 | Tanzer | 294/87.2 |
| 3,813,123 | 5/1974 | Owen | 206/150 X |
| 3,830,361 | 8/1974 | Klygis | 206/428 X |
| 3,938,656 | 2/1976 | Owen | 206/427 X |

*Primary Examiner*—Steven E. Lipman
*Attorney, Agent, or Firm*—Edward L. Benno; Robert W. Beart

[57] ABSTRACT

Multipackaging devices made of a resilient plastics-material such as low density polyethylene. The devices are made in strip form and are integrally interconnected longitudinally of the strip for continuous machine application to adjacent rows of containers with selective transverse severance of the applied strip to form individual packages of selected members of containers. The strip comprises a row of bands along each side thereof with intersecting and diagonally arranged substantially straight-line band segments extending between the side bands. The band segments cooperate with each other and with the side bands to define additional intermediate bands between the side bands. The strip is substantially narrower than the width of the rows of containers so that substantial transverse stretching of the strip is required to apply the side and intermediate bands to the rows of containers. In the strip the band segments cooperate with the side bands so that transverse stretching forces need only be applied to the side marginal edges of the strip to expand the strip for application to the rows of containers. That cooperation may be defined as resulting from an isotropic arrangement wherein upon application of stretching forces on either side of the strip an isotropic pattern of expansion occurs to give an unusual and unexpected result.

17 Claims, 6 Drawing Figures

MULTIPACKAGING DEVICES

BACKGROUND OF THE INVENTION

Plastics-material strips of integrally interconnected bands have been used in the prior art to form packages of selected numbers of containers, and various machines and methods have been developed for application of the strips to groups or rows of containers with the bands of the strips encircling the containers. In the prior art there are many more plastics-material multipackaging devices or carriers than there are applicating machine developments or designs for applying the carriers to containers. Thus, while the configuration of a particular prior art carrier device may be meritorious, more often than not it has added little to the art or science of multipackaging because of the absence in the art of a method and machine for applying such a carrier device. Those skilled in this art will understand that the multipackaging devices or carriers that have made the greatest contribution to the art have been those carrier designs which have been the impetus for successful applicating machine and packaging system developments. A series of such carrier designs began with the original developments of a Mr. Ougljesa Jules Poupitch, see U.S. Pat. No. 2,874,835. Mr. Poupitch's patents were assigned to the Illinois Tool Works Inc. of Chicago, Illinois and various engineers of that company have continued his work. That series of carrier designs led to the successful development of two basic types of now commercially successful applicating machines, one which is described in U.S. Pat. No. 3,383,828 and the other being described in U.S. Pat. Nos. 3,032,943 and 3,032,944. The present commercial models of those carriers and machines which are being used on a worldwide basis, for primarily the multipackaging of cans into six-packs, represent the present state of the subject art. In those machines, a plurality of pins or jaw elements positively control the stretching and application of each band of the carrier to the individual containers.

SUMMARY OF THE INVENTION

Against the foregoing background, the subject invention represents a unique advance in the art. That advance is unique because the invention is a radical departure from known carrier designs wherein the bands must be substantially individually stretched and applied to the containers. Because of the configuration of the bands of the strips of the present invention stretching forces need only be applied transversely outwardly in the vicinity of the side marginal edges of the strip.

Briefly, a multipackaging devices strip of the present invention comprises an integrally interconnected row of elongated bands along each side of the strip with the portion of the strip between those bands comprising a plurality of substantially straight-line intersecting band segments which are arranged diagonally of the strip. The band segments, in cooperating with each other and with the side bands, form intermediate bands within the strip. The invention comprises at least one intermediate band between each transversely disposed pair of side bands, and it is contemplated that the teachings of the invention include, and may be used to make, a multipackaging devices strip of more than one intermediate band between each trnsversely disposed pair of side bands.

Other objects and features of the invention will be apparent upon perusal of the hereinafter specification read in conjunction with the drawings.

DETAILED DESCRIPTION OF THE PREFERRED EMBODIMETS

Figure 1:
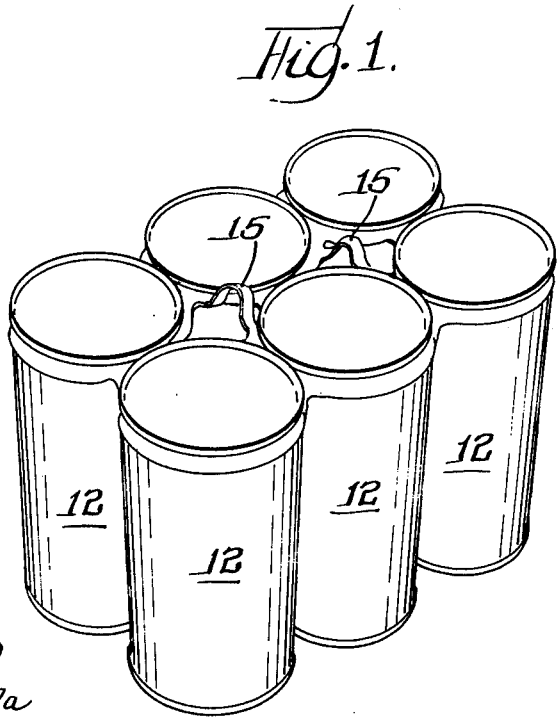
FIG. 1 is an isometric view of a container package made with one embodiment of the present invention.
Figure 2:
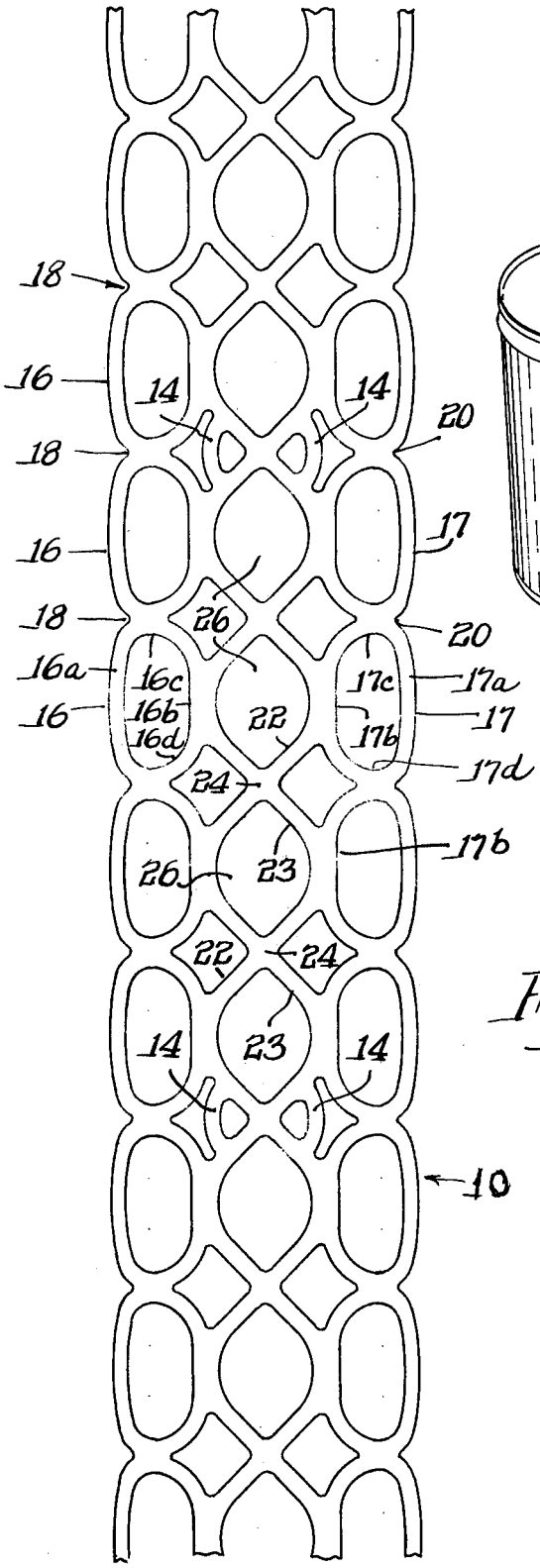
FIG. 2 is a plan view of a section of a strip constructed according to the invention in an embodiment for making packages of twelve containers.
Figure 3:
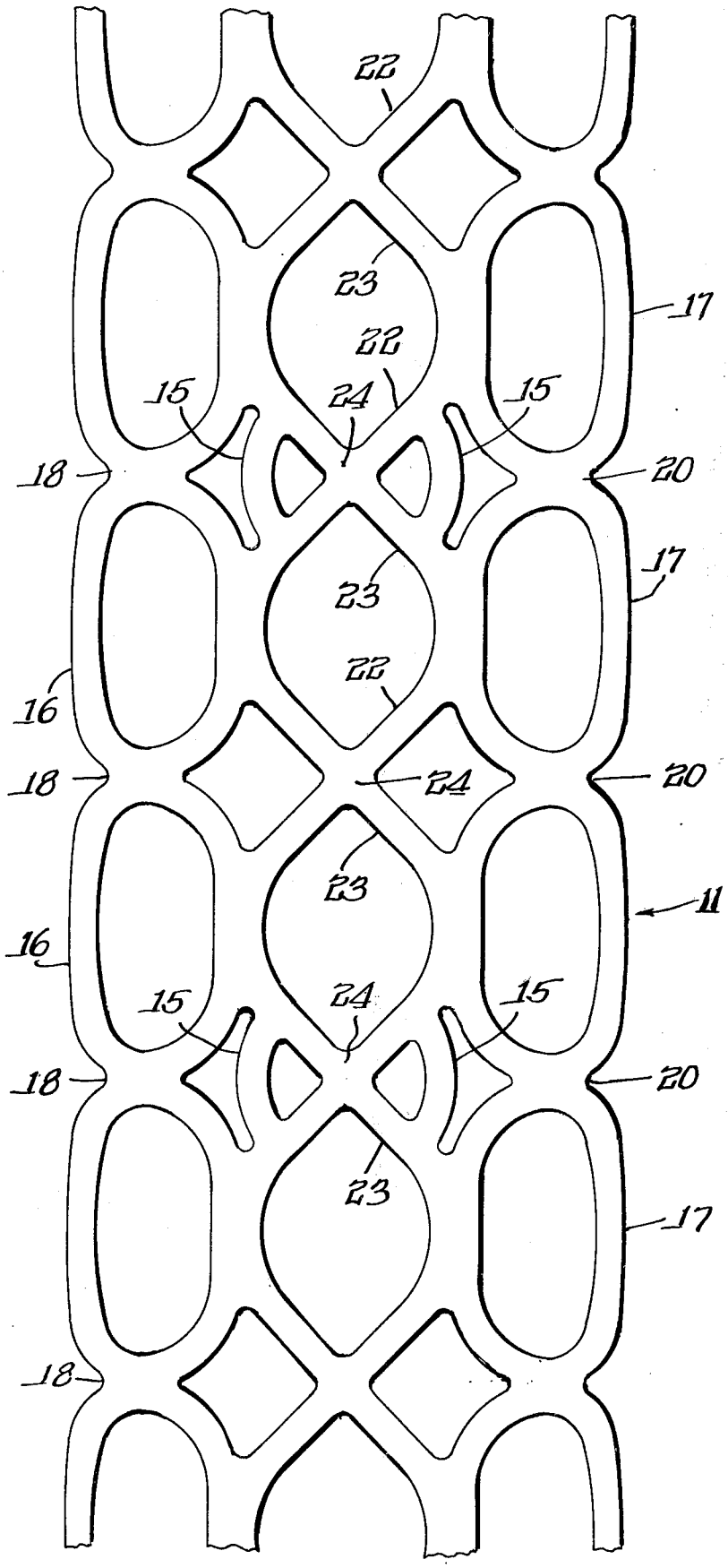
FIG. 3 is a plan view of another embodiment of the invention showing a strip from which packages, such as the package of FIG. 1, may be made.
Figure 4:
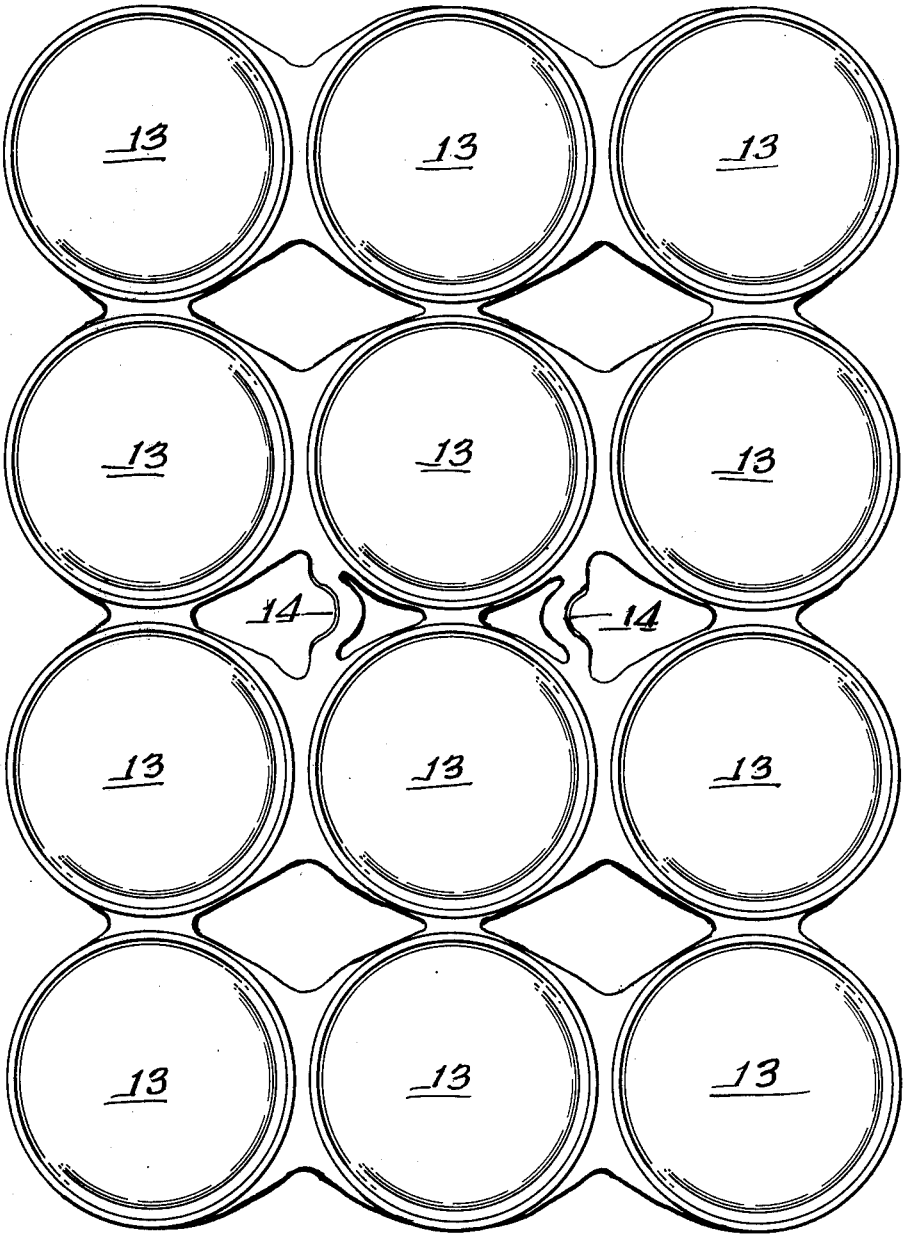
FIG. 4 is a top plan view of a package made with one of the devices of the strip of FIG. 2.

The strip sections, 10 in FIG. 1 and 11 in FIG. 3, of the invention shown in the drawings are both embodiments for multipackaging three rows of adjacent containers and those embodiments are shown in the drawings substantially accurately in configuration. Further, the disclosed containers for those embodiments are substantially cylindrical containers, such as the cans 12 of FIG. 2 or the cans 13 of FIG. 4. It is believed that upon an understanding of the two embodiments shown and described that those skilled in the art will understand how to make the strip of the invention for application to more than three rows of containers. It will be further understood tat while FIGS. 1 and 4 show packages where a single carrier or device from the strip of the invention has been applied to the upper end portions of the containers, such devices may be applied about some other portion of the containers such, for example, as the lower end portions of the containers. An understanding of the invention will further teach one skilled in the art how to make a strip of the invention for other than circular containers, and that the handle elements or finger gripping means shown at 14 in FIGS. 2 and 4 and at 15 in FIGS. 1 and 3 may be formed within the strip at other than the locations shown, or completely omitted if unnecessary for any particular multipackaging arrangement.

All embodiments of the invention are intended to be made of a resilient, flexible plastic material, such, for example, as low density polyethylene. Such a plastics-material is relatively low in cost and has the necessary properties of resiliency, elasticity and deformability which render such a material suitable for making the subject invention. The thickness of the plastics-material may be varied depending upon the actual size of the containers to be multipackaged and the weight or loads which the device must handle or absorb in use. One well-known common use for such devices, is, of course, to provide a package which enables a consumer to buy and carry home a plurality of container packaged product. The invention contemplates that in some embodiments the packages formed may not be intended for transport by a person carrying the same, but may form part of a shipping and distribution system for large numbers of containers. Thus, the thickness of the plastics-material may vary over a wide range. However, for a well-known consumer "6-pack," a plastics-material having a thickness of about 18 mils or less is suitable.

In the embodiments shown in the drawings, the strips 10 and 11 are formed to have a series of integrally interconnected bands 16 along one side marginal edge portion thereof and what amounts to a mirror image series of integrally interconnected bands 17 along the other side of the strip. Each of the bands 16 and 17 is substantially elongated longitudinally of the strip and the inner periphery of each band is circumferentially continuous. The outer periphery of each band 16 and 17 may be generally described as approximating parallelism with the inner periphery thereof. The outer peripheries of adjacent bands 16 are integrally interconnected by webs 18, and in a comparable manner the bands 17 are integrally interconnected by webs 20.

In further detail, each band 16 may be described as having an outer band portion 16*a*, an inner band portion 16*b*, and end portions 16*c* and 16*d*. The band portions 16*a* and 16*b* are substantially straight segments longitudinally of the strip with the band portion 16*a* being longer than the band portion 16*b*. The end portions 16*c* and 16*d* are curved band portions which interconnect the ends of the band portions 16*a* and 16*b*. The various band portions 17*a*, 17*b*, 17*c* and 17*d* of the bands 17 are respectively substantially mirror images of the band portions 16*a*, 16*b*, 16*c* and 16*d*.

Each of the strip embodiments 10 and 11 of the invention further comprises intermediate band segments 22 and 23. One band segment 22 and one band segment 23 is formed as an integral intersecting pair of band segments. In the embodiments shown, the angle of intersection is approximately at 90° angle, although the invention contemplates that other angles may be used. Each pair of intersecting band sections 22 and 23 is integrally formed in the strip so that its intersection 24 straddles a transverse line through the webs 18 and 20 on opposite sides of the strip. One end of each band segment 23 is integrally connected to the band portion 16*b* of a band 16 with the other end of that band segment being integrally connected to the inner band portion 17*b* of the band 17 which is longitudinally adjacent to the band 17 transversely opposite from the band 16 to which the one end of the band segment 23 is connected. In a similar manner, one end of each band segment 22 is connected to the inner band portion 17*b* of a band 17 with the other end thereof integrally connected to the inner band portion 16*b* of the band 16 which is longitudinally adjacent to the band 16 which is transversely opposite of the band 17 to which the one end of the band segment 22 is connected.

While the band segments 22 and 23 have been described as substantially straight-line band segments, the four corners of each intersection 24 are curvilinear as shown, and the end connections of the band segments 22 and 23 to the bands 16 and 17 merge along curvilinear lines into their connections with the bands 16 and 17.

The longitudinally adjacent pairs of intersecting band segments 22 and 23 define the intermediate apertures 26. The shape of each aperture 26 in the present disclosure may be described as generally lemon-shaped, and the opposite ends of each aperture 26 in a longitudinal direction lie on transverse lines drawn through the longitudinally disposed ends of the end portions 16*c* and 17*c* of the bands 16 and 17 and the ends of the end portions 16*d* and 17*d* of the bands 16 and 17. Further, the peripheral margin of each aperture 26 is circumferentially continuous and is of a length substantially equal to the length of the inner peripheral margin of the bands 16 and 17. In one reduction to practice of the invention the length of the periphery of the apertures 26 measured 6.016 inches (15.281 cm) while the length of the inner peripheral margin of the apertures 16 and 17 measured 6.160 inches (15.646 cm). The lengths of the inner peripheral margins of the apertures 26 and the bands 16 and 17 are less than the circumferential dimension of the containers, such as containers 12 and 13, intended to be packaged with either strip 10 or 11.

As described above, the strips 10 and 11 are intended for machine application to containers and thus the strip sections shown in FIGS. 2 and 3 merely represent small longitudinal sections of much longer strips which, for example, could inlcude one or several thousand or more carrier devices in the strip. Such strips are generally wound upon reels and in that condition delivered to the applicating apparatus for machine application to the containers. A suitable machine for applying the strips 10 or 11 of the subject invention is shown and described in the co-pending United States application of Benno et al. Ser. No. 583,079, filed June 2, 1975 now U.S. Pat. No. 3,959,949. The application drum of the machine of that application is partially shown in FIGS. 5 and 6 and those showings are an attempt to visually display how the srips 10 and 11 are configured when they are stretched by transversely opposite stretching forces applied within the strip against the portions 16*a* and 17*a*, respectively, of the bands 16 and 17. It is important to note in the showing of FIGS. 5 and 6 that the apertures 26 of the intermediate bands are enlarged by the transversely applied stretching forces without a serious distortion of the apertures 26. The inventor of the subject invention has found that when he attempted to stretch known prior art carriers of at least three bands wide by opposed transversely directed stretching forces on the side bands, the center bands and their apertures invariably distorted into shapes unsuitable for projection over containers such as cans. He often found that the longitudinally disposed ends of the center bands would stretch into substantially straight lines which would interfere with attempted applications of such carriers to cylindrical containers. Importantly, the curvilinear shapes of the longitudinally disposed ends of the apertures 26 are substantially maintained during the application of transversely opposed stretching forces. An attempted analysis of why the longitudinally disposed ends of the apertures 26 maintain such excellent curvilinear configurations, with good stretching configurations of the bands 16 and 17, for application to containers such as cans 12 and 13 has led the inventor to believe that the intersection areas 24 of each intersecting pair of straight-line band segments 22 and 23 is an isotropic area. In other words, upon application of transversely opposed stretching forces the intersection areas 24 exhibit a tendency to grow substantially equally in all directions and thus the curvilinear configuration of the ends of the apertures 26 is maintained during such stretching.

Figure 5:
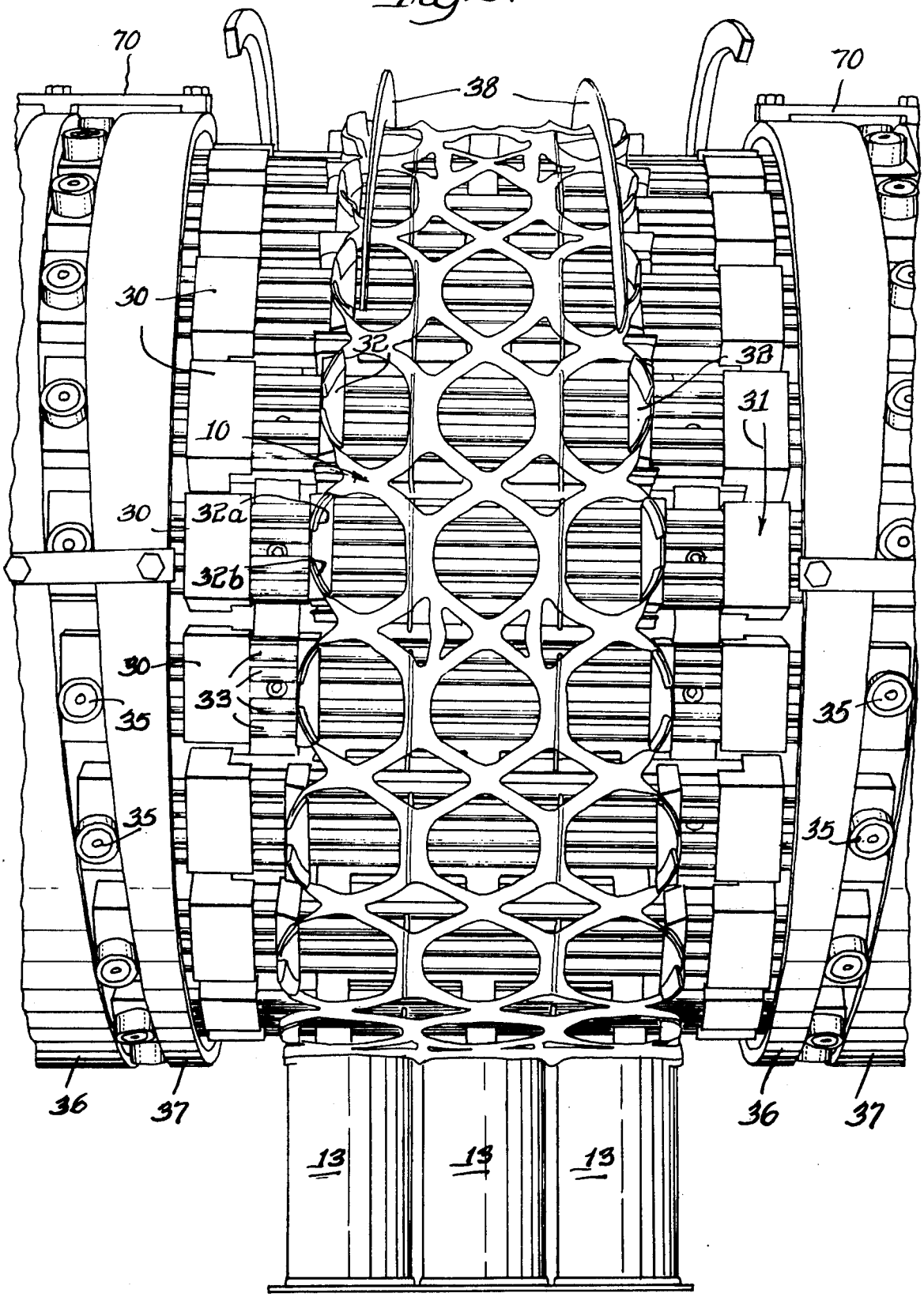
FIG. 5 is a side elevational view of a portion of an applicating machine for stretching and applying one embodiment of the invention to containers, and particularly showing the strip of FIG. 2.
Figure 6:
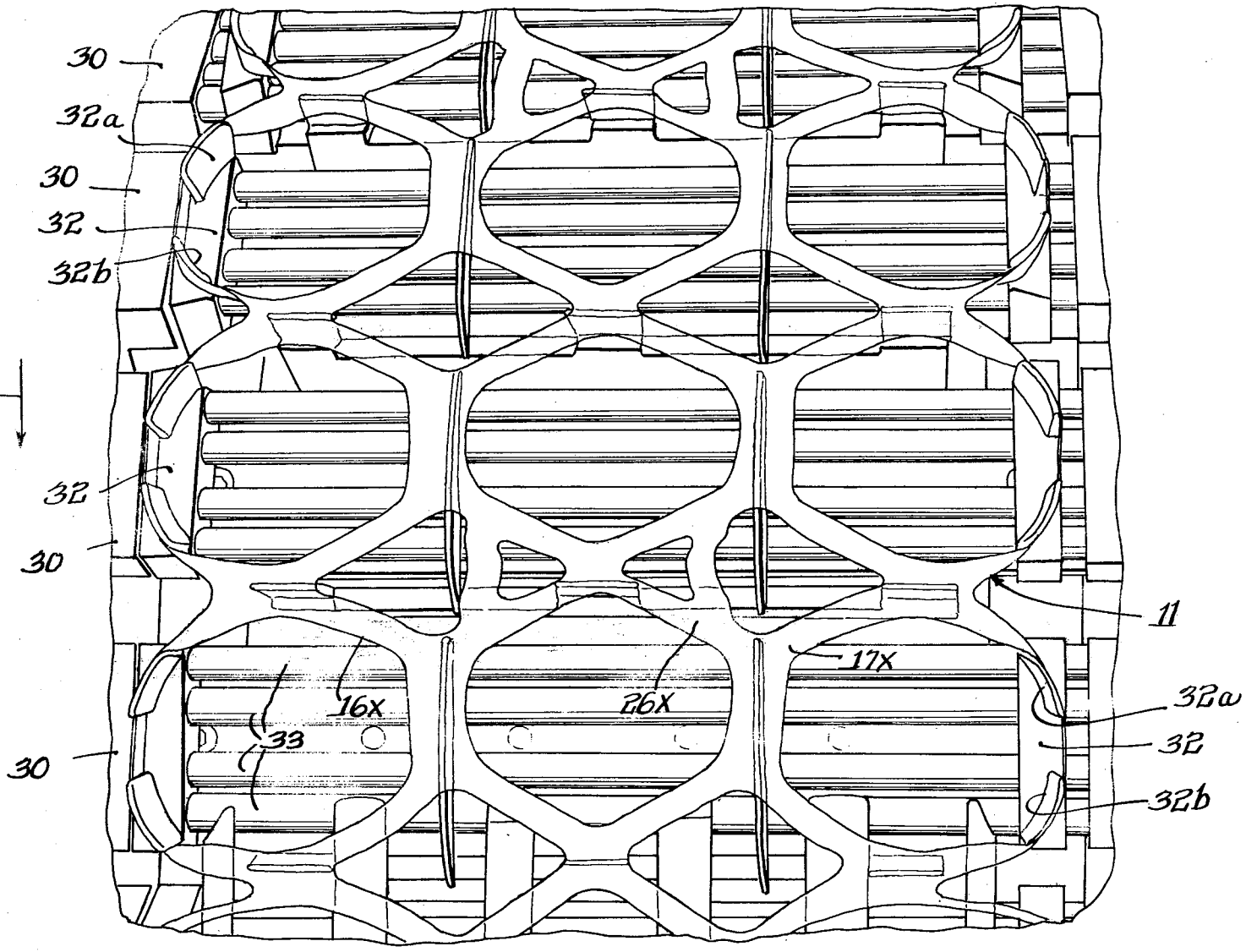
FIG. 6 is a view of a portion of a machine such as shown in FIG. 5, but viewed substantially from beneath the stretching and applicating mechanism to show the general configuration of the strip substantially at the position of application.

For a complete understanding of how the applicating drum shown in FIGS. 5 and 6 operates, reference is made to the co-pending United States application of Benno et al, Ser. No. 583,079, filed June 2, 1975 now U.S. Pat. No. 3,959,949. A brief description of the drum assembly will be given herein to explain the stretching of the strips 10 and 11 shown in FIGS. 5 and 6. The drum assembly which is partially shown in FIG. 5 is substantially cylindrical in general configuration and comprises a hub or spider rotating about a horizontal axis and carrying a plurality of jaw stations 30 circumferentially thereabout. As shown in FIG. 5, the jaw stations 30 are rotated in the direction of the arrow 31. Each jaw station 30 comprises a pair of jaws 32. Each jaw 32 comprises a pair of radially extending jaw elements 32*a* and 32*b*. The jaws 32 are carried on four rods 33, and each jaw 32 is fixed to two of the four rods 33. The rods 33 are appropriately connected to cam rollers 35 so that as the drum assembly rotates in the direction of the arrow 31 the cam rollers 35 are moved in a direction axially of the drum assembly by the annular cam plates 36 and 37 to move the jaws 32 of each jaw station 30 apart.

As shown in FIG. 5, the strip 10 is fed onto the jaw stations 30 rearwardly of the top of the drum assembly with the jaw elements 32*a* and 32*b* of the jaws entering the apertures of the bands 16 and 17. At that application position, the jaws 32 of each jaw station 30 are in their closed position or position of minimum spacing therebetween. As the drum assembly rotates, a strip guide assembly 38, partially shown at the top of FIG. 5, folds the portions 16*a* and 17*a* of the bands 16 and 17 to be substantially aligned in a direction radially of the drum assembly. As the rotating drum assembly carries the strip 10 from the guide assembly 38, the jaws 32 gradually move apart to transversely stretch the strip 10. When the bands of the strip reach the substantially vertically downward position they are moved into encircling cooperation with the containers, such as the cans 13 shown in FIG. 5. The encircling engagement of the carrier bands with the containers 13 may be described as a snap-on action. The three containers 13, shown in FIG. 5, represent three adjacent rows of containers 13 which are moving in a direction perpendicular to FIG. 5 and into the drawing. The view in FIG. 6 is taken from a position below the drum assembly and looking vertically upwardly at the assembly. Thus, the jaw stations 30 are moving in the direction of the arrow 40 in FIG. 6. In FIG. 6 the carrier bands indicated at 16*x*, 26*x* and 17*x* are the bands which would be applied to the containers 13 shown in FIG. 5. In viewing FIGS. 5 and 6 it should be kept in mind that one is viewing elements arranged about a cylinder which have been projected onto a flat sheet. It is believed clear from the showing of FIGS. 5 and 6 that the carrier strips 10 or 11 are substantially ideally stretched merely by the transversely opposed stretching forces as described for projected application onto containers, such as cans 12 or 13.

From the foregoing it may be seen that once the three rows of containers 13 have passed beneath the applicating drum, the jaw elements 32*a* and 32*b* of the jaws 32 are withdrawn from the side marginal portions of the strip by virtue of the straight-line movement of the three rows of cans and the upwardly and outwardly rotating movement of the jaws 30 about the drum and away from the straight-line movement of the cans. The strip 10 or 11 is thus applied in a continuing manner to the three rows of containers. Thereafter, selective transverse severance of the strip 10 or 11 through webs 18 and 20, and through the intersection areas 24 enables one to produce packages in multiples of three containers. If the strip has not handle means, such as handle means 15 of FIG. 1 or 14 of FIG. 4, transverse severance may be provided through each of the webs 18 and 20 and the intersection areas 24 to produce 3-packs. Further, if the packages produced are not intended to be carried by a person, but are, for example, to be part of a pallet load of packages, transverse severance might be made after, for example, every twentieth container in each row.

The handle means 15 of FIG. 1 and 14 of FIG. 4 are provided to enable a person to carry each of the packages shown in FIGS. 1 and 4. The package of FIG. 1 has been made from a strip, such as strip 11 of FIG. 3. In that embodiment the handle means 15 provide finger gripping means, and a pair of finger gripping means 15 is provided between every other pair of straight-line segments 22 and 23 longitudinally of the strip. It is obvious from FIG. 3 that transverse severance through the webs 18 and 20 and the intersecting areas 24 at the strip positions where the straight-line band segments 22 and 23 are void of finger gripping means 15 will produce packages of six containers, such as shown in FIG. 1, with a pair of finger gripping means 25 conveniently positioned within the package for gripping thereof by a person's fingers. The package of twelve containers, shown in FIG. 4, is produced by the strip of FIG. 2 where every fourth pair of straight-line segments 22 and 23 in the strip 10 is provided with the handle elements 14. Thus, with transverse severance of the strip 10 being made through the webs 18 and 20 and the intersecting areas 24 which are two positions longitudinally of the strip 10 from the handle elements 14 will produce the packages of twelve containers, such as shown in the top plan view in FIG. 4. Again, two handle elements 14 are disposed conveniently substantially at the center of the package for carrying of the package by those elements. Where packages, such as shown in FIG. 4, are made with relatively heavy containers 13 such that gripping of the handle elements 14 by a person's fingers is uncomfortable, the invention contemplates that a simple U-shaped bale member (not shown, but of a type generally contemplated in U.S. Pat. No. 2,874,835) with hook portions on the ends of the legs thereof may be hooked beneath the handle elements 14 to provide a more comfortable carrying arrangement for such heavy packages by a person.

In making the strips of the invention, handle elements 14 or finger gripping means 15 must be so formed as to avoid any interference with the stretching of the straight-line band segments 22 and 23 as previously described. Reductions to practice of the strips 10 ans 11 have established that when the finger gripping means 15 or the handle elements 14 are formed as curved strap elements extending between the straight-line band segments 22 and 23 as shown, substantially no interference with the stretching of those straight-line band segments 22 and 23 is produced.

Having described the invention, it should be understood that changes can be made in the described embodiments by one skilled in the art within the spirit and scope of the hereinafter following claims.

I claim:

1. A multipackaging device for machine application to a plurality of containers to form multipackages of said containers, said multipackaging device comprising an elongated strip of resilient, elastic plastic flat sheet material, said strip comprising a first series of integral interconnected flat bands extending longitudinally of said strip along one side thereof, a second series of integral interconnected flat bands extending longitudinally of said strip along the other side thereof, said first and second series of bands being spaced-apart transversely of said strip and the bands of said first series of bands being in transverse alignment with the bands of said second series of bands, each of said bands having an inner peripheral dimension sufficiently less than the outer circumferential dimension of said containers to enable each of said bands to be capable of being stretched and circumferentially applied to one of said containers, a plurality of intersecting and substantially straight-line flat band segments integrally connected between said first and second series of bands longitudinally of said strip with the longitudinal axes of said band segments extending diagonally of the longitudinal axis of said strip to define intermediate bands within said strip and in substantially transverse alignment with transverse pairs of said first and second series of bands, and each of said intermediate bands having an inner peripheral dimension sufficiently less than the outer circumferential dimension of said containers to enable each of said intermediate bands in cooperation with said first and second series of bands to be capable of being stretched and and circumferentially applied to one of said containers upon application of a transverse stretching force to the transversely adjacent bands of said first and second series of bands, whereby a multipackage of containers may be produced upon transversely stretching said first and second series of bands and circumferentially applying the first and second series of bands simultaneously with said intermediate bands to said containers.

2. Carrier stock for machine application to a plurality of containers to form packages of said containers, said stock comprising an elongated strip of resilient, elastic plastic flat sheet material, said strip comprising a first series of integrally interconnected flat bands extending longitudinally of said strip along one side thereof, a second series of integrally interconnected flat bands extending longitudinally of said strip along the other side thereof, said first and second series of bands being spaced-apart transversely of said strip and the bands of said first series of bands being in transverse alignment with the bands of said second series of bands, each of said bands having an inner peripheral dimension sufficiently less than the outer circumferential dimension of said containers to enable each of said bands to be capable of being stretched and circumferentially mounted on one of said containers, a plurality of intersecting and substantially straight-line flat band segments integrally connected between said first and second series of bands longitudinally of said strip with the longitudinal axes of said band segments extending diagonally of the longitudinal axis of said strip to define intermediate bands within said strip and in substantially transverse alignment with transverse pairs of said first and second series of bands, and each of said intermediate bands having an inner peripheral dimension sufficiently less than the outer circumferential dimension of said containers to enable each of said intermediate bands in cooperation with said first and second series of bands to be capable of being stretched and circumferentially mounted on one of said containers upon application of a transverse stretching force to the adjacently positioned first and second series of bands, whereby a continuous series of packages of containers may be produced upon stretching and circumferentially mounting said stock on said containers and individual packages thereafter formed by transverse severance of said stock between selected longitudinally adjacent transverse pairs of said first and second series of bands and midway through the intersection of longitudinally adjacent straight-line band segments.

3. Carrier stock for machine application to a plurality of containers to form packages of said containers, said stock comprising an elongated strip of resilient, elastic plastic flat sheet material, said strip comprising two series of flat bands extending longitudinally of said strip along each side thereof with said bands arranged in transversely aligned and spaced-apart pairs, each of said bands having an inner peripheral dimension sufficiently less than the outer circumferential dimension of said containers to enable each of said bands to be capable of being stretched and circumferentially applied to a container, a plurality of pairs of intersecting substantially straight-line flat segments, the intersection of each intersecting pair of straight-line segments positioned centrally between two longitudinally adjoining pairs of said transversely aligned pairs of bands and with each of the ends of each intersecting pair of straight-line segments integrally connected to a peripheral portion of one of said bands of said two longitudinally adjoining pairs of said transversely aligned pairs of bands, said straight-line segments having lengths defining intermediate bands between longitudinally adjacent ones of said pairs of intersecting substantially straight-line segments and between said bands of each transversely aligned pair of bands which intermediate bands have an inner peripheral dimension sufficiently less than the outer circumferential dimension of said containers to enable said intermediate bands to be capable of being stretched and circumferentially applied to said containers, whereby packages of containers may be produced upon stretching and circumferentially applying said stock to said containers and by subsequent transverse severance of said stock between selected longitudinally adjoining pairs of said transversely aligned pairs of bands and midway through the intersecting pair of longitudinally adjoining straight-line segments therebetween.

4. Carrier stock as defined in claim 3, said strip being formed with said bands and said band segments having sufficient width and elasticity to produce a general frusto-conical to cylindrical container gripping configuration in said bands when said bands are stretched and circumferentially applied to said containers.

5. Carrier stock as defined in claim 4, wherein said straight-line segments define one intermediate band between each of said transversely aligned pairs of bands.

6. Carrier stock as defined in claim 5, and a pair of strip segments connected to every other one of each intersecting pair of straight-line segments outwardly of the defined intermediate bands, said strip segments being shaped to form opposed finger gripping means for a package produced by transverse severance of said stock between the longitudinally adjoining pairs of said transversely aligned pairs of bands and the intersecting pair of straight-line segments therebetween which is void of a pair of said strip segments.

7. Carrier stock as defined in claim 5, and a pair of strip segments connected to every fifth one of each intersecting pair of straight-line segments outwardly of the defined intermediate bands, said strip segments being shaped to form opposed handle elements for a package produced by transverse severance of said stock between the longtitudinally adjoining pairs of transversely aligned pairs of bands and the intersecting pair of straight-line segments therebetween which are longitudinally midway between said intersecting pairs of straight-line segments having pairs of said strip segments connected thereto.

8. Carrier stock as defined in claim 5, and the angle between the longitudinal axes of each intersecting pair of straight line segments being an angle of substantially 90°.

9. Carrier stock as defined in claim 5, said bands being elongated in shape with the longitudinal axis of the apertures of said bands aligned substantially longitudinally of said strip.

10. Carrier stock as defined in claim 5, the inner periphery of each of said bands being continuous and circumferentially uninterrupted.

11. Carrier stock for machine application to a plurality of containers to form packages of said containers wherein the machine passes more than two rows of containers therethrough and includes an endless succession of pairs of jaws with each pair of jaws relatively movable apart in a direction transversely of said rows to stretch a carrier stock transversely over more than two rows of containers, said stock comprising an elongated strip of resilient, elastic plastic flat sheet material, said strip comprising a series of elongated integrally interconncted flat bands extending longitudinally of said strip along each side thereof with pairs of said bands being spaced-apart and transversely aligned of said strip and with the longitudinal axes of said bands directed longitudinally of said strip, a plurality of substantially straight-line flat band segments integrally connected between opposed portions of said bands within said strip and arranged in intersecting pairs disposed diagonally of the longitudinal axis of said strip to define elongated intermediate bands within said strip in substantial transverse alignment with said pairs of bands and with the longitudinal axis of said intermediate bands directed longitudinally of said strip, and each of said pairs of bands and said intermediate bands having an inner peripheral dimension less than the outer circumferential dimension of said containers, whereby said successive pairs of jaws are each capable of engaging one of said pairs of bands to stretch said pairs of bands and simultaneously said intermediate band transversely of said strip over more than two rows of containers.

12. Carrier stock for machine application to three rows of containers, said stock formed from a resilient deformable plastic sheet material of uniform thickness, and comprising three rows of integrally joined flat container encircling bands, the integral connections between bands longitudinally of said rows being capable of severance to form individual container carriers in selected multiples of three bands, each of said bands having a continuous uninterrupted aperture stretchable into a shape substantially complementary to the outer circumferential shape of one of said containers, the maximum diameter of said apertures measured longitudinally of said stock being substantially greater than the maximum diameter of said apertures measured transversely of said stock, the circumferential dimension of said apertures of said bands being substantially equal to each other and less than the outer circumferential dimension of the containers intended to be associated therewith, and the maximum diameter of each of said apertures measured longitudinally of said stock being substantially equal.

13. Carrier stock as defined in claim 12, and the distance between said integral connections between bands longitudinally of said rows being substantially equal longitudinally of said stock.

14. Carrier stock as defined in claim 13, and handle elements comprising pairs of strap elements, each pair of strap elements integrally interconnected at certain equally spaced positions longitudinally of said stock between two longitudinally adjacent ones of the middle row of bands on opposite sides of the integral connection of said middle row of bands longitudinally of said stock, whereby the integral connections between bands longitudinally of said rows which are midway between said certain equally spaced positions are capable of being severed to form individual container carriers in predetermined multiples of three bands with said handle elements longitudinally midway thereof.

15. An apertured carrier strip stock for machine application to three rows of cylindrical containers wherein said strip stock is stretched transversely by arcuate jaws of the machine solely within the opposed longitudinal side margins of said stock for application to said containers, said stock formed from a resilient deformable plastic sheet material and comprising three contiguous rows of transversely and longitudinally integrally interconnected flat container encircling bands, the inner circumferential dimension of said bands being less than the outer circumferential dimension of the cylindrical containers intended to be associated therewith, said bands elongated in a direction longitudinally of said stock and being configured and integrally interconnected to provide that upon insertion of said arcuate jaws of said machine solely within the portions of said bands at the opposed longitudinal side margins of said strip stock and upon transverse stretching of said strip stock by said arcuate jaws said bands are stretched to a shape configuration and circumferential measurement substantially approximating the outer surface of said cylindrical containers.

16. A carrier for a plurality of substantially cylindrical containers, said carrier formed of a resilient deformable plastic sheet material of substantially uniform thickness and comprising a plurality of flat bands integrally interconnected in series of more than two in number both longitudinally and transversely of said carrier, each of said bands having circumferentially continuous inner marginal edges defining container receiving apertures, the circumferential dimension of said apertures being less than the outer circumferential dimension of the containers intended to be associated therewith, said bands being elongated longitudinally of said carrier and further and shaped and interconnected longitudinally and transversely of said carrier to produce a substantially circular pattern of expansion of the bands which are between the bands along the longitudinal sides of said carrier in response to holding forces applied at the ends of the carrier and transversely outward stretching forces applied solely to the outer side marginal edges of the bands along the longitudinal sides of said carrier to enable said container receiving apertures to receive said containers, whereafter said bands will circumferentially grip said containers upon release of said stretching forces.

17. Carrier stock for machine application to a plurality of substantially cylindrical containers wherein the machine passes three rows of containers therethrough and includes a series of pairs of jaws with the series extending longitudinally of said rows and with each pair of jaws aligned transversely of said rows and relatively movable apart in a direction transversely of said rows of containers to stretch said carrier stock in a transverse direction over said three rows of containers, said carrier stock comprising a strip of resilient elastic plastic sheet material of substantially uniform thickness, said strip comprising three rows of flat bands integrally interconnected transversely and longitudinally, each of said bands having a circumferentially continuous inner marginal edge defining a container receiving aperture, the circumferential dimension of said apertures being less than the outer circumferential dimension of the containers intended to be associated therewith, said apertures being elongated in a direction longitudinally of said strip, said bands being shaped and interconnected to produce a substantially circular pattern of expansion of the center row of bands in respsonse to transversely outward stretching forces applied solely by said jaws within the apertures of the outboard ands which extend along the side marginal edges of said strip to enable said apertures to receive said containers, whereafter said bands will circumferentially grippingly embrace each of said containers upon the release of said stretching forces.

* * * * *